US010722015B1

(12) United States Patent
Chu

(10) Patent No.: US 10,722,015 B1
(45) Date of Patent: Jul. 28, 2020

(54) DOUBLE-SAFETY ADJUSTMENT HOOK FOR LENGTH-ADJUSTABLE LUGGAGE STRAP

(71) Applicant: Tonglu Huabang Hardware Tools Co., Ltd., Hangzhou, Zhejiang Province (CN)

(72) Inventor: Zhenghua Chu, Hangzhou (CN)

(73) Assignee: Tonglu Huabang Hardware Tools Co., Ltd., Hangzhou, Zhejiang (CN)

( * ) Notice: Subject to any disclaimer, the term of this patent is extended or adjusted under 35 U.S.C. 154(b) by 0 days.

(21) Appl. No.: 16/421,057

(22) Filed: May 23, 2019

(30) Foreign Application Priority Data

May 14, 2019 (CN) ..... 2019 2 0685500 U

(51) Int. Cl.
*A45C 13/02* (2006.01)
*A44B 13/00* (2006.01)
*A45C 5/03* (2006.01)

(52) U.S. Cl.
CPC ..... *A45C 13/02* (2013.01); *A44B 13/00* (2013.01); *A45C 5/03* (2013.01)

(58) Field of Classification Search
CPC ..... A45C 13/02; A45C 5/03; A44B 13/00
See application file for complete search history.

(56) References Cited

U.S. PATENT DOCUMENTS 384,512 A * 6/1888 Dillon ..... A44B 11/24 24/165
1,775,174 A * 9/1930 Roy ..... A44C 5/145 24/328
5,136,756 A * 8/1992 Krauss ..... F16G 11/048 24/129 R
5,146,657 A * 9/1992 Frano ..... A44B 11/28 24/265 BC
5,283,930 A * 2/1994 Krauss ..... F16G 11/101 24/129 R
5,596,791 A * 1/1997 Parsons ..... F16G 11/103 24/115 R
5,669,119 A * 9/1997 Seron ..... F16G 11/101 24/115 H
6,401,309 B1 * 6/2002 Yang ..... F16G 11/046 24/115 H
6,851,163 B2 * 2/2005 Selby ..... B62J 7/08 114/218

(Continued)

*Primary Examiner* — Robert Sandy
*Assistant Examiner* — David M Upchurch
(74) *Attorney, Agent, or Firm* — PROI Intellectual Property US; Klaus Michael Schmid

(57) ABSTRACT

The invention discloses a double-safety adjustment hook for a length-adjustable luggage strap, which mainly includes a luggage strap, an adjustment hook housing, a reinforcing bar and a reinforcing crossbeam, wherein the luggage strap is penetrated into a strap inlet hole arranged at the bottom of the adjustment hook housing, penetrated through a strap passage, and passed through a U-turn and through a turn bypassing hole fixed on the reinforcing crossbeam, a strap clamping groove having bevelled teeth on both side walls thereof is arranged below the turn bypassing hole, the luggage strap is passed through the turn bypassing hole into the strap clamping groove and penetrated through the bevelled teeth, and finally exits from a strap outlet hole arranged at the bottom of the adjustment hook housing.

4 Claims, 3 Drawing Sheets

(56) References Cited

U.S. PATENT DOCUMENTS

| | | | | |
|---|---|---|---|---|
| 8,695,176 | B2 * | 4/2014 | Gangakhedkar | B60P 7/0823<br>24/265 H |
| 9,254,778 | B2 * | 2/2016 | Gangakhedkar | B60P 7/0823 |
| 2009/0287316 | A1 * | 11/2009 | Veatch | A61F 2/588<br>623/63 |
| 2011/0064535 | A1 * | 3/2011 | Tardif | B60P 7/0807<br>410/100 |
| 2018/0368533 | A1 * | 12/2018 | Chan | A44B 11/2592 |

* cited by examiner

DOUBLE-SAFETY ADJUSTMENT HOOK FOR LENGTH-ADJUSTABLE LUGGAGE STRAP

FIELD OF THE INVENTION

The invention relates to the field of luggage cases, and particularly to a double-safety adjustment hook for a length-adjustable luggage strap.

BACKGROUND OF THE INVENTION

Most of the luggage cases used in the daily life have fixed sizes, can accommodate certain luggage items and are generally equipped with luggage straps which are used or not based on the amount of the luggage carried. If a luggage case is stuffed with luggage items, a luggage strap can be pressed at the bottom of the case; and in case of fewer luggage items which cannot stuff the luggage case, the luggage strap functions to fix the luggage, and clothing luggage or even valuables are fixed in the case, which can prevent the luggage from moving with the luggage case and avoid unnecessary loss. The fixed luggage items do not easily shake to touch an inner wall of the luggage case during the process of dragging the luggage case. If the luggage case is placed unsteadily or pushed down, the luggage strap can function to protect the luggage items, especially valuables.

An existing luggage strap and a hook are fixedly connected, and the hook cannot be disassembled and separated from the luggage strap so that the length of the luggage strap cannot be adjusted; and the design of fixed connection between the hook and the luggage strap limits the length of the luggage strap, thus the luggage strap cannot be provided to bind a variety of goods luggage of different sizes and volumes. In addition, for a variety of goods luggage of different sizes and volumes, it is necessary to select luggage straps of various lengths to bind the goods luggage, and hence these luggage straps are extremely inconvenient to carry and use.

SUMMARY OF THE INVENTION

An object of the invention is to provide a double-safety adjustment hook for a length-adjustable luggage strap so as to overcome the disadvantages of the prior art.

The object of the invention is achieved by the following technical solution: the double-safety adjustment hook for a length-adjustable luggage strap mainly comprises a luggage strap, an adjustment hook housing, a reinforcing bar and a reinforcing crossbeam, wherein the luggage strap is penetrated into a strap inlet hole arranged at the bottom of the adjustment hook housing, penetrated through a strap passage, and passed through a U-turn and through a turn bypassing hole fixed on the reinforcing crossbeam, a strap clamping groove having bevelled teeth on both side walls thereof is arranged below the turn bypassing hole, the luggage strap is passed through the turn bypassing hole into the strap clamping groove and penetrated through the bevelled teeth, and finally exits from a strap outlet hole arranged at the bottom of the adjustment hook housing, and the free adjustment of the actually desired length of the luggage strap is achieved by controlling the length of the luggage strap that exits from the strap outlet hole; and one end of the luggage strap that exits from the strap outlet hole is covered with a clamping cap.

Further, the bevelled teeth are symmetrically disposed on the both side walls of the strap clamping groove.

Further, the structure of the reinforcing bar matches that of an upper part of the adjustment hook housing so that the reinforcing bar can be enclosed in the adjustment hook housing, and a tail end of the reinforcing bar is bent to form the reinforcing crossbeam for fixing the turn bypassing hole.

Further, an upper part of the adjustment hook housing is bent to form a hook head which is elliptical.

The invention has the following beneficial effects: the length of the luggage strap can be adjusted freely to suit a variety of goods luggage of different sizes and volumes; the clamping cap and the bevelled teeth in the strap clamping groove provide double safety to effectively prevent the luggage strap from falling off; the luggage strap can be pulled out of the adjustment hook and separately placed in a luggage case to reduce the space occupied; and the design of the elliptical hook head prevents the human body from being scratched.

Figure 1:
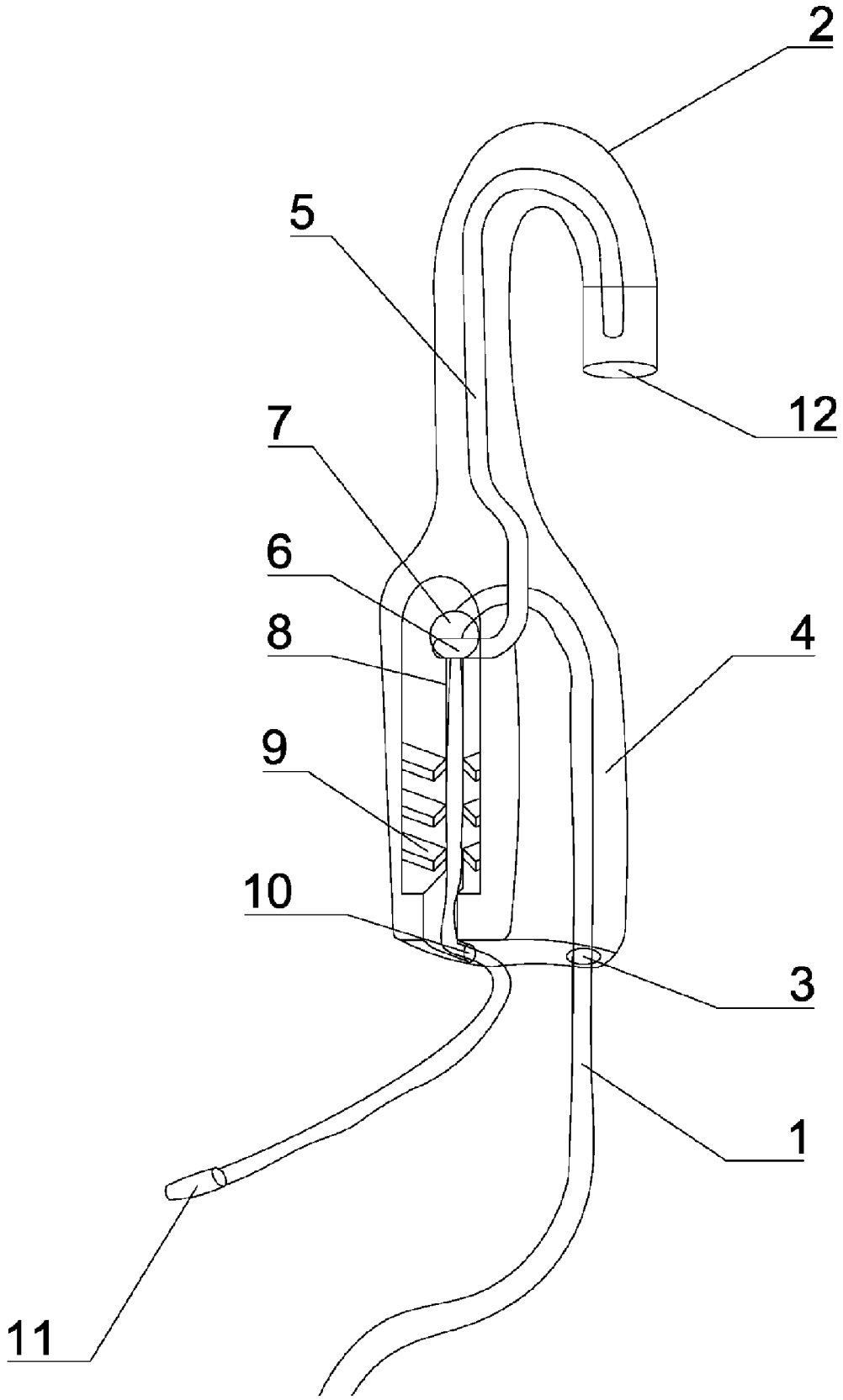
FIG. 1 is a schematic structural view of the invention.
Figure 2:
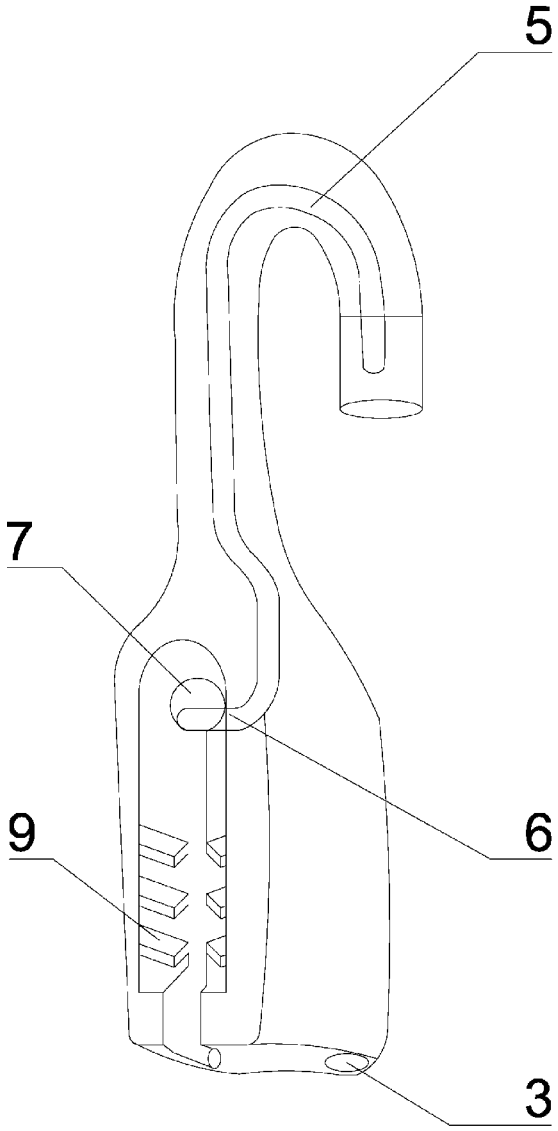
FIG. 2 is a schematic structural view of an adjustment hook.
Figure 3:
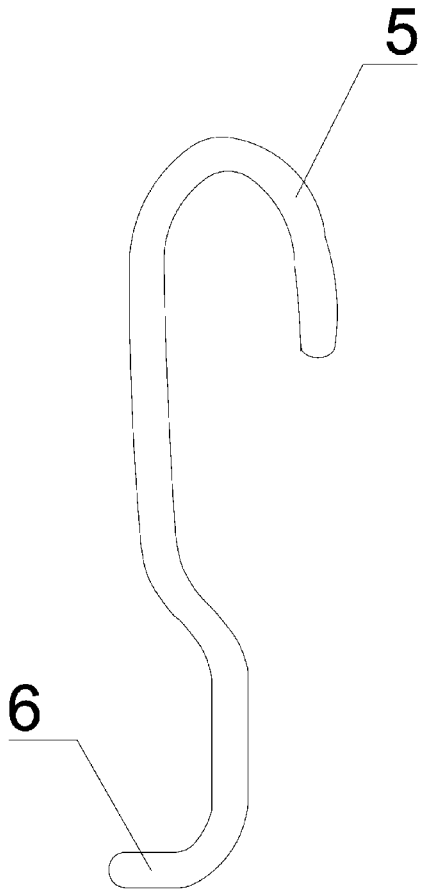
FIG. 3 is a schematic structural view of a reinforcing bar.
Figure 4:
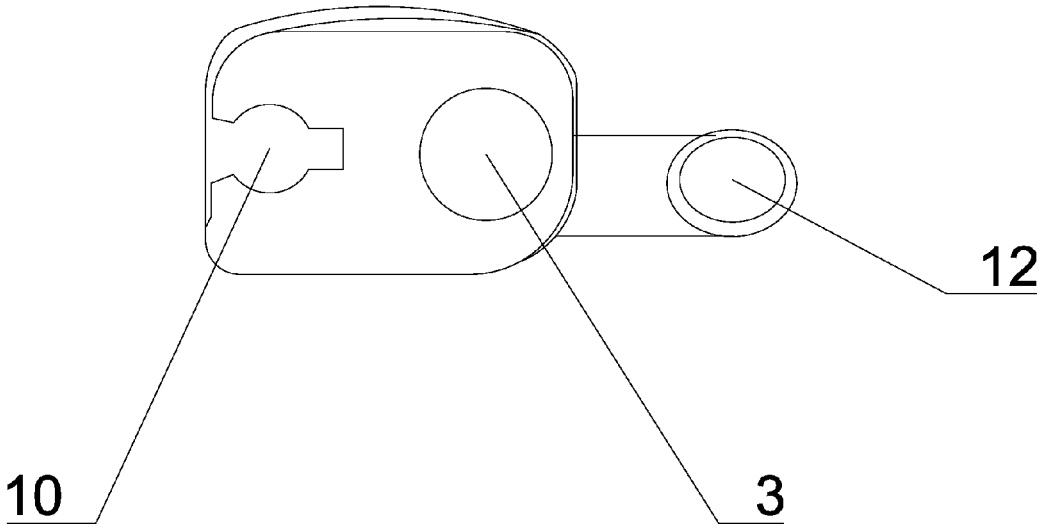
FIG. 4 is a bottom structural view of the invention.

Description of reference numerals: luggage strap 1; adjustment hook housing 2; strap inlet hole 3; strap passage 4; reinforcing bar 5; reinforcing crossbeam 6; turn bypassing hole 7; strap clamping groove 8; bevelled teeth 9; strap outlet hole 10; clamping cap 11; hook head 12.

DETAILED DESCRIPTION OF THE INVENTION

The invention will be described below in detail with reference to the drawings.

Embodiment: as shown in the Figures, the double-safety adjustment hook for a length-adjustable luggage strap mainly comprises a luggage strap 1, an adjustment hook housing 2, a reinforcing bar 5 and a reinforcing crossbeam 6, wherein the luggage strap 1 is penetrated into a strap inlet hole 3 arranged at the bottom of the adjustment hook housing 2, penetrated through a strap passage 4, and passed through a U-turn and through a turn bypassing hole 7 fixed on the reinforcing crossbeam 6, a strap clamping groove 8 having bevelled teeth 9 on both side walls thereof is arranged below the turn bypassing hole 7, the luggage strap 1 is passed through the turn bypassing hole 7 into the strap clamping groove 8 and penetrated through the bevelled teeth 9, and finally exits from a strap outlet hole 10 arranged at the bottom of the adjustment hook housing 2, and the free adjustment of the actually desired length of the luggage strap is achieved by controlling the length of the luggage strap 1 that exits from the strap outlet hole 10; one end of the luggage strap 1 that exits from the strap outlet hole 10 is covered with a clamping cap 11 for thickening an head end of the luggage strap 1, so that the head end of the luggage strap 1 is greater than the diameter of the strap outlet hole 10, thereby preventing the luggage strap 1 from sliding out of the bevelled teeth 9 and being unhooked; and the bevelled teeth 9 have the effect of tighter clamping as the luggage strap 1 is pulled more tightly, and provide double safety together with the clamping cap 11. In addition, when the adjustment hook is not used, the luggage strap 1 can be pulled out, so that the adjustment hook and the luggage strap 1 are separately placed in a luggage case to reduce the space occupied, and hence convenient to carry and use.

Preferably, the bevelled teeth 9 are symmetrically disposed on the both side walls of the strap clamping groove 8.

Preferably, the structure of the reinforcing bar 5 matches that of an upper part of the adjustment hook housing 2 so that the reinforcing bar can be enclosed in the adjustment hook housing 2, and a tail end of the reinforcing bar 5 is bent to form the reinforcing crossbeam 6 for fixing the turn bypassing hole 7. When goods are bound by the luggage strap 1 with a greater pulling force, the stress is mainly on the reinforcing crossbeam 6, and hence the adjustment hook housing 2 is not easily cracked and broken.

Preferably, an upper part of the adjustment hook housing 2 is bent to form a hook head 12 which is elliptical to prevent the human body from being scratched.

It should be understood that, for those skilled in the art, the equivalent replacements or changes of the technical solutions and the concept of the invention should fall within the protection scope of the appended claims of the invention.

What is claimed is:

1. A double-safety adjustment hook for a length-adjustable luggage strap, comprising a luggage strap, an adjustment hook housing, a reinforcing bar and a reinforcing crossbeam, wherein the luggage strap is penetrated into a strap inlet hole arranged at the bottom of the adjustment hook housing, penetrated through a strap passage, and passed through a U-turn and through a turn bypassing hole fixed on the reinforcing crossbeam, a strap clamping groove having bevelled teeth on both side walls thereof is arranged below the turn bypassing hole, the luggage strap is passed through the turn bypassing hole into the strap clamping groove and penetrated through the bevelled teeth, and finally exits from a strap outlet hole arranged at the bottom of the adjustment hook housing, and a free adjustment of the actually desired length of the luggage strap is achieved by controlling the length of the luggage strap that exits from the strap outlet hole; and one end of the luggage strap that exits from the strap outlet hole is covered with a clamping cap.

2. The double-safety adjustment hook for a length-adjustable luggage strap according to claim 1, wherein the bevelled teeth are symmetrically disposed on the both side walls of the strap clamping groove.

3. The double-safety adjustment hook for a length-adjustable luggage strap according to claim 1, wherein the reinforcing bar comprises a structure that matches that of an upper part of the adjustment hook housing so that the reinforcing bar can be enclosed in the adjustment hook housing, and a tail end of the reinforcing bar is bent to form the reinforcing crossbeam for fixing the turn bypassing hole.

4. The double-safety adjustment hook for a length-adjustable luggage strap according to claim 1, wherein an upper part of the adjustment hook housing is bent to form a hook head which is elliptical.

* * * * *